US007242883B2

(12) United States Patent
Miura

(10) Patent No.: US 7,242,883 B2
(45) Date of Patent: Jul. 10, 2007

(54) IMAGE FORMATION APPARATUS HAVING EXPOSURE TIMING CONTROL

(75) Inventor: Yohhei Miura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 245 days.

(21) Appl. No.: 10/885,582

(22) Filed: Jul. 8, 2004

(65) Prior Publication Data

US 2005/0036797 A1 Feb. 17, 2005

(30) Foreign Application Priority Data

Jul. 10, 2003 (JP) ..... 2003-195410
Apr. 21, 2004 (JP) ..... 2004-126004

(51) Int. Cl.
*G03G 15/043* (2006.01)

(52) U.S. Cl. ..... 399/51; 399/94

(58) Field of Classification Search ..... 399/40, 399/41, 51, 66, 299, 302, 303, 94, 301; 347/116, 347/133
See application file for complete search history.

(56) References Cited

U.S. PATENT DOCUMENTS 5,828,925 A * 10/1998 Yoshizawa ..... 399/39
5,907,741 A * 5/1999 Matsuzawa et al. ..... 399/44
6,829,444 B2 * 12/2004 Ashikawa ..... 399/44
7,050,737 B2 * 5/2006 Kobayashi ..... 399/94
7,167,657 B2 * 1/2007 Inoue et al. ..... 399/44

FOREIGN PATENT DOCUMENTS

JP 09171275 A * 6/1997
JP 2001-027833 1/2001
JP 2001034030 A * 2/2001
JP 2001-296755 10/2001
JP 2003098792 A * 4/2003

OTHER PUBLICATIONS

U.S. Appl. No. 10/725,450, filed Dec. 3, 2003, Andoh et al.

* cited by examiner

*Primary Examiner*—Robert Beatty
(74) *Attorney, Agent, or Firm*—Oblon, Spivak, McClelland, Maier & Neustadt, P.C.

(57) ABSTRACT

An image formation apparatus is disclosed, wherein temperatures of two or more places on a transfer/conveyance belt are measured. Timing of writing to photo conductor drums based on pixel clock signals is controlled in reference to differences between the measured temperatures, while a printing medium is being conveyed.

26 Claims, 12 Drawing Sheets

IMAGE FORMATION APPARATUS HAVING EXPOSURE TIMING CONTROL

BACKGROUND OF THE INVENTION

1. Field of the Invention

The present invention generally relates to an image formation apparatus, and especially relates to an image formation apparatus wherein an image formation position of a color is adjusted in reference to an image formation position of another color based on temperature variance of conveyance means for conveying a printing medium and intermediate transfer means for performing intermediate image imprinting, such as an intermediate imprinting belt for transferring an image.

2. Description of the Related Art

In recent years and continuing, image formation apparatuses are required to deliver full-color prints at a higher printing speed, and to be small-sized. In order to fulfill the requirements, image formation apparatuses employing a quadruple tandem system are becoming popular.

However, in the quadruple tandem system, there is a problem in that colors are not precisely superposed, resulting in a color gap, due to fluctuations of conveyance speed of the printing medium, which is caused by thermal expansion and contraction of the conveyance belt indicated by temperature fluctuation.

In order to solve the above problems, Patent Reference 1 discloses an image formation apparatus capable of suppressing a temperature rise of intermediate transfer means, such as an intermediate imprinting belt, with minimum energy and a simple configuration, keeping the same dimensions of the image formation apparatus, and without the complications of a special mechanism. Specifically, the intermediate imprinting belt is directly cooled by a fan, or alternatively, the intermediate imprinting belt is indirectly cooled by a heat transfer pipe attached to a roller that drives the intermediate imprinting belt.

[Patent reference 1]

JP, 2001-296755, A

[Problem(s) to be solved by the Invention]

According to the image formation apparatus of Patent Reference 1, the temperature rise (heat gain) of the intermediate transfer means may be suppressed; however, if the temperature of the intermediate transfer means actually rises, delivery of a high quality image can be difficult.

SUMMARY OF THE INVENTION

It is a general object of the present invention to provide an image formation apparatus that substantially obviates one or more of the problems caused by the limitations and disadvantages of the related art.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by the image formation apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides an image formation apparatus that delivers a high quality image of two or more colors without a color gap even if the temperature rises and the conveyance speed of the printing medium fluctuates.

To achieve the object, the present invention provides, among other things, exposure means for exposing an image supporting object that is uniformly charged for forming an image in different colors, conveyance means for conveying a printing medium, intermediate transfer means such as an intermediate imprinting belt for performing image transfer to the printing medium that is conveyed by the conveyance means, temperature measurement means for measuring temperatures at plural places on the conveyance means and the intermediate transfer means intermediate imprinting belt, and exposure control means for controlling exposure timing of the exposure means based on the difference in the temperatures measured by the temperature measurement means. In essence, the exposure control means adjust the exposure timing of certain colors (such as yellow, magenta, and cyan) in reference to a reference color (such as black) according to the temperature difference. Further, the exposure control is carried out depending on image transfer speeds, printing medium conveyance speeds, printing medium kinds, and printing medium sizes.

The effect of the present invention is that a high quality multi-color image without color gaps is obtained even when the conveyance speed of the printing medium varies due to temperature differences of the conveyance means and the intermediate transfer means.

DESCRIPTION OF THE PREFERRED EMBODIMENTS

In the following, embodiments of the present invention are described with reference to the accompanying drawings.

According to the present invention, a high quality multicolor image without color gaps is obtained even when the conveyance speed of the printing medium varies due to temperature differences of the conveyance means and the intermediate transfer means.

The First Embodiment

Hereafter, the first embodiment of the present invention is described.

As for color image formation, there are two typical methods, namely, a direct imprint method wherein toner images in different colors are formed on two or more photo conductors, and are directly imprinted onto a printing medium; and an indirect imprint method wherein toner images in different colors are formed on two or more photo conductors, are first imprinted onto an intermediate transfer means such as an intermediate imprinting belt, and then imprinted onto the printing medium.

Further, image formation apparatuses called tandem systems are available, wherein two or more photo conductors are arranged facing the printing medium, or the intermediate transfer means as applicable. In the case of the tandem system image formation apparatus, electrophotography processes, such as formation and development of electrostatic latent images, are performed on photo conductors for each color of yellow (Y), magenta (M), cyan (C), and black (K) (the four colors); and the images are imprinted on the printing medium in the case of the direct imprint method, and on the intermediate transfer means in the case of the indirect imprint method.

With the tandem system color image formation apparatus, an endless belt is often employed for supporting and conveying a printing medium in the case of the direct imprint method, and an endless belt for receiving and supporting the images from the photo conductors in the case of the intermediate imprint method. Further, four photo conductors constituting an imaging unit are arranged on a side of the endless belt, which side is called the outer side.

With the tandem system color image formation apparatus, it is important that the toner images in the four colors be superposed with sufficient precision for obtaining a high quality color image.

Now, descriptions follow about the image formation apparatus according to the embodiments of the present invention as applied to a color laser printer ("LASER beam printer") that employs the direct imprint method of the electro-photography method.

Figure 1:
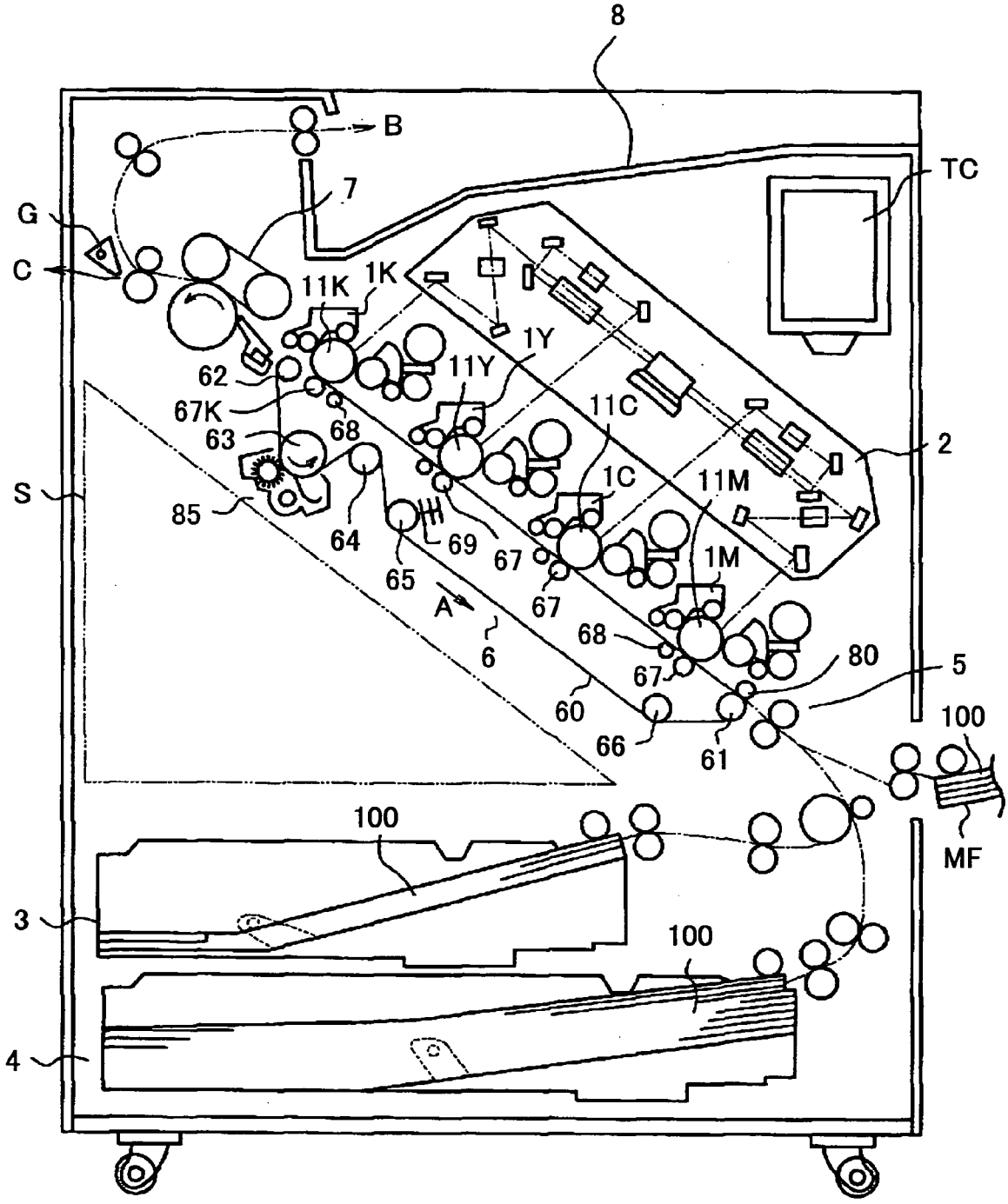
FIG. 1 shows the outline configuration of an image formation apparatus according to an embodiment of the present invention.

FIG. 1 shows the outline of the image formation apparatus according to the first embodiment of the present invention. In the following, the configuration and operations of the image formation apparatus of this embodiment are described using FIG. 1.

The image formation apparatus includes four toner image formation units 1M, 1C, 1Y, and 1K for forming images in magenta (M), cyan (C), yellow (Y), and black (K), respectively, which toner image formation units are arranged in sequence from the upstream side (right bottom) to the downstream side (left top) along the moving direction of a printing medium 100 (i.e., in the direction in which a transfer/conveyance belt 60 (an endless belt) runs as shown by an arrow A in FIG. 1). Hereafter, suffixes M, C, Y, and K represent items for the colors of magenta, cyan, yellow, and black, respectively.

The toner image formation units 1M, 1C, 1Y, and 1K are equipped with photo conductor drums 11M, 11C, 11Y, and 11K, respectively, serving as image support objects, and development units. Further, the toner image formation units 1M, 1C, 1Y, and 1K are set up so that the rotational axes of the photo conductor drums become parallel, and at a predetermined pitch in the moving direction of the printing medium 100.

The image formation apparatus according to the first embodiment includes an optical writing unit 2, feed cassettes 3 and 4, a resist roller pair 5, a transfer unit 6, a fixing unit 7 of a belt fixing method, and a delivery tray 8, in addition to the toner image formation units 1M, 1C, 1Y, and 1K. Here, the transfer unit 6 also serves as a belt driving unit, and includes the transfer/conveyance belt 60 serving as means for transferring toner images from the photo conductor drums 11M, 11C, 11Y, and 11K to the printing medium 100, and conveyance means for supporting and conveying the printing medium 100 such that the printing medium 100 passes through imprint positions of the toner image formation units 1M, 1C, 1Y, and 1K.

Further, the image formation apparatus includes a manual feed tray MF, and a toner supply container TC. Furthermore, although not illustrated, a disposed toner bottle, a two-side imprinting and reversing unit, a power supply unit, etc., are provided in a space S shown by the two-dot chain line.

The optical writing unit 2 is equipped with a luminous source, a polygon mirror, an f-θ lens, a reflective mirror, etc., and irradiates the surface of each of the photo conductor drums 11M, 11C, 11Y, and 11K, scanning a laser beam based on image data.

Figure 2:
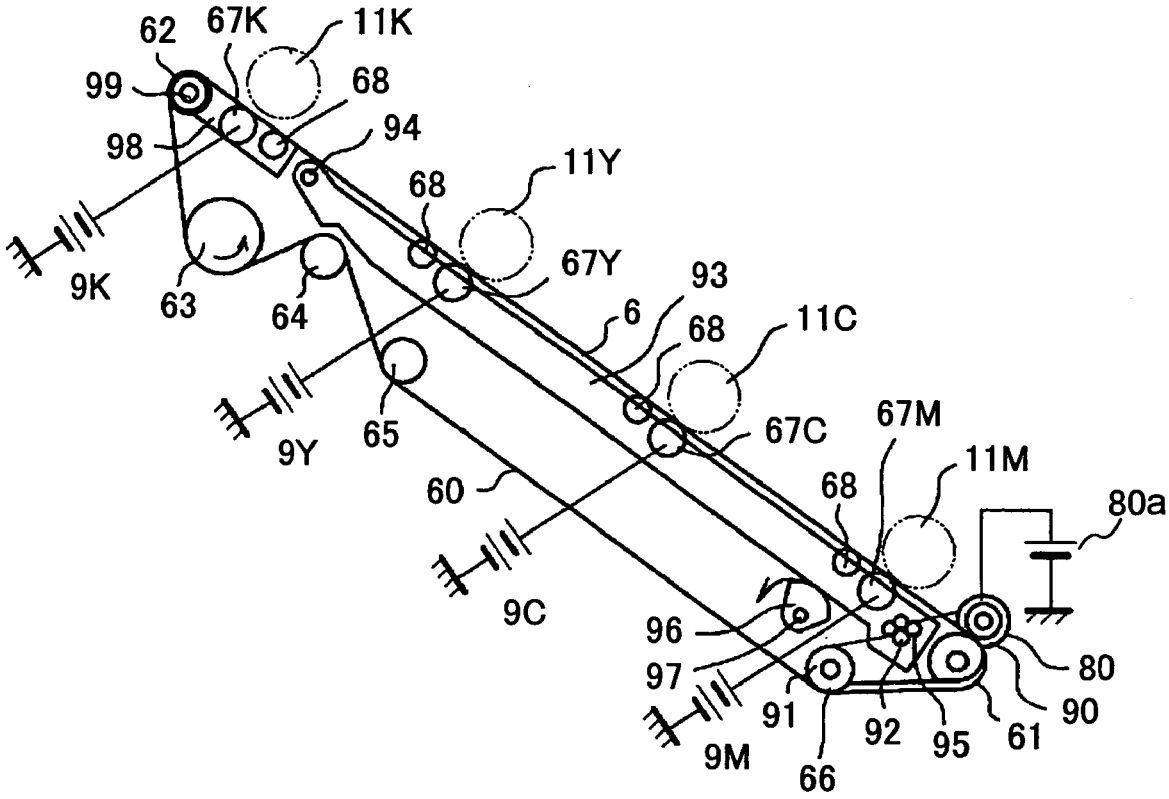
FIG. 2 shows details of a printing unit of the image formation apparatus according to the embodiment of the present invention.

FIG. 2 shows details of the transfer unit 6 according to the first embodiment of the present invention. In the following, the configuration and operations of the transfer unit 6 are described using FIG. 2.

The transfer/conveyance belt 60 prepared in the transfer unit 6 is an endless single-layer belt, volume resistance of which is as high as ranging $10^9$–$10^{11}$ Ωcm, and is made of PVDF (poly fluoride vinylidene). The transfer/conveyance belt 60 is wound around rollers 61 through 68 such that the transfer/conveyance belt 60 passes through the imprint positions where the transfer/conveyance belt 60 touches the photo conductor drums 11M, 11C, 11Y, and 11K. The rollers 61 through 68 include an entrance roller 61, an outlet roller 62, a drive roller 63, a tension roller 65, and backup rollers 68.

An electrostatic adsorption roller 80 is provided on the outer side of the transfer/conveyance belt 60, countering the entrance roller 61 that is provided at the most upstream part in the printing medium moving direction. A predetermined voltage is applied to the electrostatic adsorption roller 80 from a power supply 80*a*. The printing medium 100 that passes between the two rollers 61 and 80 is electrostatically adhered to the transfer/conveyance belt 60.

The drive roller 63 that is rotationally driven by a driving source (not illustrated) is for driving the transfer/conveyance belt 60 by friction in the direction of an arrow associated with the drive roller 63 shown in FIG. 2.

As transfer electric-field generating means for forming a transfer electric field in each imprint position, transfer bias applying units 67M, 67C, 67Y, and 67K are provided at positions opposite to the photo conductor drums 11M, 11C, 11Y, and 11K, respectively, such that the transfer/conveyance belt 60 passes between each transfer bias applying unit and the corresponding photo conductor drum.

The transfer bias applying units 67M, 67C, 67Y, and 67K are made of metal covered by sponge and the like. A transfer bias is applied from transfer bias power supplies 9M, 9C, 9Y, and 9K to the metal portions, serving as roller core bars, of the transfer bias applying units 67M, 67C, 67Y, and 67K, respectively. The transfer bias provides a transfer charge to the transfer/conveyance belt 60, and the transfer electric field of predetermined intensity is formed at each imprint position, that is, between the surface of the transfer/conveyance belt 60 and the photo conductor drums 11M, 11C, 11Y, and 11K.

Further, in order that the printing medium 100 properly contact the photo conductor drums 11M, 11C, 11Y, and 11K at the imprint positions, and in order to obtain suitable transfer nips, the transfer unit 6 is equipped with the backup rollers 68.

The transfer bias applying units 67M, 67C, and 67Y and the backup rollers 68 are prepared on a rocking bracket 93 that can swing with the rotating center being a rotation axle 94. The rocking bracket 93 swings clockwise when a cam 96 fixed to a camshaft 97 rotates in the direction of an arrow that is associated with the cam 96.

The entrance roller 61 and the adsorption roller 80 are supported by an entrance roller bracket 90, and can be rotated clockwise from the state of FIG. 2 with an axle 91 being the rotational center. A hole 95 prepared in the rocking bracket 93 and a pin 92 prepared in the entrance roller bracket 90 are engaged such that the entrance roller 61 and the adsorption roller 80 swing in a manner interlocked with the rotation of the rocking bracket 93.

With the clockwise swing of the entrance roller bracket 90 and the rocking bracket 93, the transfer bias applying units 67M, 67C, and 67Y, and the backup rollers 68 are separated from the photo conductors 11M, 11C, and 11Y, and also the entrance roller 61 and the adsorption roller 80 move downward. In this manner, the photo conductors 11M, 11C, and 11Y are prevented from contacting the transfer/conveyance belt 60 when an image is formed only in black color.

As for the black color, an outlet bracket 98 that can swing with the rotational center at an axle 99 supports the transfer bias applying unit 67K and the nearby backup roller 68. The axle 99 is coaxial with the center of the outlet roller 62. When the transfer unit 6 is to be detached from and attached to the main part of the image formation apparatus, the transfer unit 6 is rotated clockwise and counterclockwise, respectively, by operation of a handle that is not illustrated, such that the transfer bias applying unit 67K and the nearby backup roller 68 are separated from/attached to the photo conductor 11K for black image formation.

A cleaning unit 85 (refer to FIG. 1) that includes a brush roller and a cleaning blade is provided nearby the drive roller 63 such that the outer surface of the transfer/conveyance belt 60 contacts the cleaning unit 85. The cleaning unit 85 is for removing foreign substances, such as toner adhered to the transfer/conveyance belt 60.

A roller 64 is provided on the down-stream side of the drive roller 63, the downstream being in the moving direction of the transfer/conveyance belt 60, such that the outer surface of the transfer/conveyance belt 60 is pushed. This is to ensure that a sufficient area of the transfer/conveyance belt 60 contacts the drive roller 63. Further downstream from the roller 64, the tension roller 65 pressed by a spring 69 (refer to FIG. 1) is provided such that pressure is given to the transfer/conveyance belt 60.

A chain line in FIG. 1 shows the conveyance path of the printing medium 100 that is supplied by one of the feed cassettes 3 and 4, or manually through the manual feed tray MF. The printing medium 100 is conveyed to a stop position by a conveyance roller, being guided by a conveyance guide that is not illustrated, the stop position being where the resist roller pair 5 is prepared. The resist roller pair 5 sends out the printing medium 100 at a predetermined timing. The printing medium 100 is supported by the transfer/conveyance belt 60, is conveyed towards the toner image formation units 1M, 1C, 1Y, and 1K, and passes each transfer nip.

Toner images developed by the photo conductor drums 11M, 11C, 11Y, and 11K of the toner image formation units 1M, 1C, 1Y, and 1K, respectively, are transferred one by one onto the printing medium 100 at corresponding transfer nips, and are imprinted on the printing medium 100 by the action of the transfer electric field and nip pressure. In this manner, a full color toner image is formed on the printing medium 100.

Then, after the toner images are transferred, the surface of the photo conductor drums 11M, 11C, 11Y, and 11K are cleaned and discharged by a cleaning unit, and the image formation apparatus stands by for forming the next. electrostatic latent images.

The full color toner image formed on the printing medium 100 is fixed by a fixing unit 7, and the printing medium 100 is conveyed to one of a first delivery direction B and a second delivery direction C depending on the rotation posture of a change guide G.

When the printing medium 100 is conveyed in the delivery direction B to the delivery tray 8, the printing medium 100 is stacked with its face (printed surface) down.

When the printing medium 100 is delivered in the delivery direction C, the printing medium 100 is conveyed to another apparatus, such as a sorter and stapling apparatus, which is not illustrated, or conveyed back to the resist roller pair 5 through a switchback unit for double-side printing.

The heat of the fixing unit 7 causes the temperature of an adjacent roller to rise (typically, the outlet roller 62), the raised temperature of the adjacent roller causes the heating of a part of the transfer/conveyance belt 60, and the mechanical intensity of the part changes. This causes the part of the transfer/conveyance belt 60 to stretch (thermally expand) in the moving direction of the transfer/conveyance belt 60. For this reason, the conveyance speed of an upstream side from the stretched part becomes lower than a predetermined target conveyance speed. For this reason, when an image in two or more colors (for example, Y, M, C, and K) is formed on the transfer/conveyance belt 60, a color gap is generated.

In order to cope with the problem of the color gap, according to the image formation apparatus of the present embodiment, temperatures of a predetermined number of places on the transfer/conveyance belt 60 are measured, and timing of writing is controlled, which writing is performed on the photo conductor drums 11M, 11C, and 11Y and 11K by the luminous source (such as a laser source, and LED array) contained in the optical writing unit 2. In this manner, the color gap that is otherwise generated after a predetermined idle period is compensated for.

Figure 3:
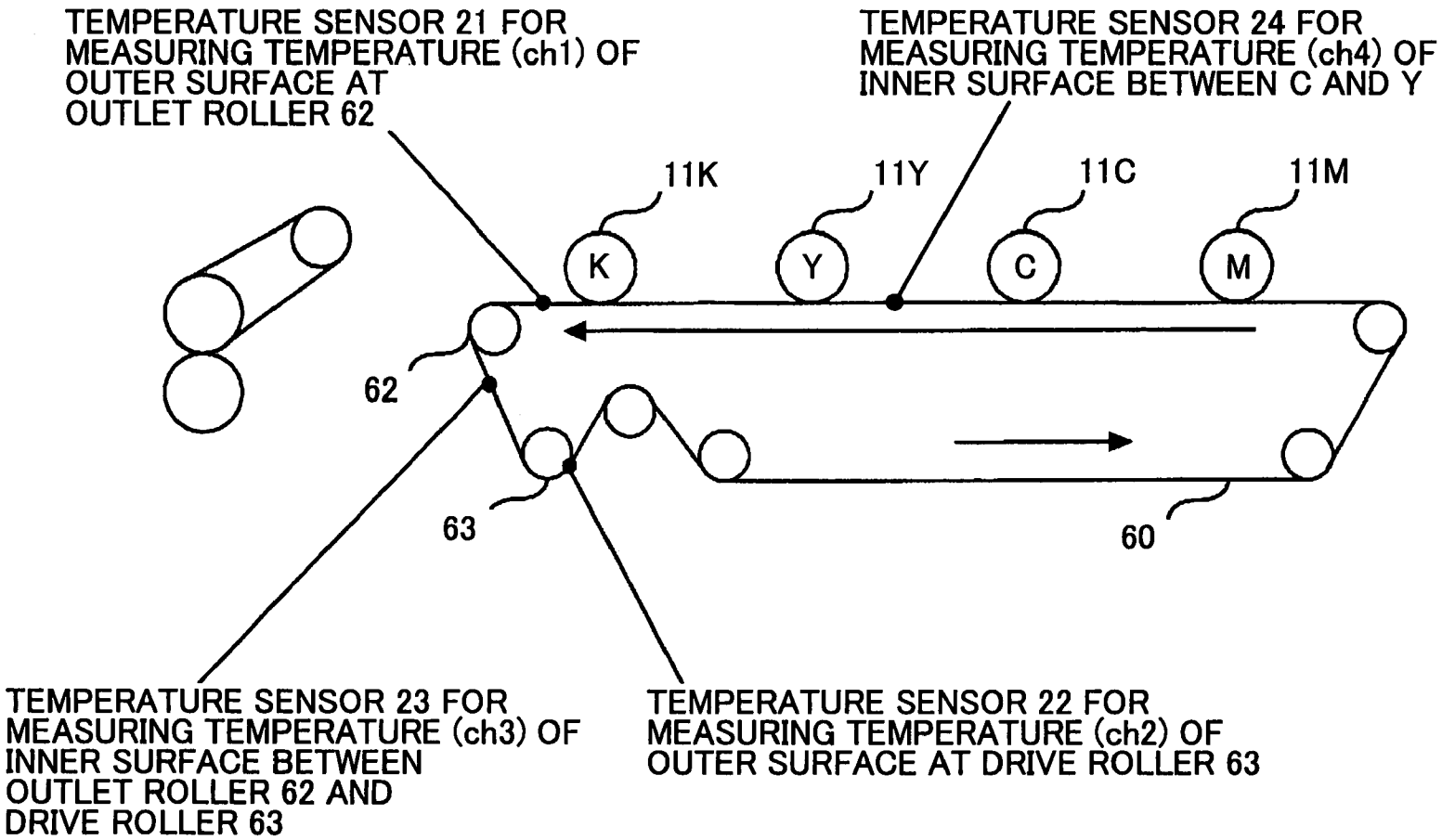
FIG. 3 shows details of the printing unit with temperature sensors being shown according to the embodiment of the present invention.

FIG. 3 shows the configuration of the transfer unit 6, including the transfer/conveyance belt 60 for performing temperature measurement according to the first embodiment of the present invention. Descriptions follow as to how the temperatures of the transfer/conveyance belt 60 are measured with reference to FIG. 3.

Two or more temperature sensors for measuring the temperature of the predetermined places of the transfer/conveyance belt 60 are installed close to the transfer/conveyance belt 60. According to the present embodiment, four temperature sensors 21 through 24 are installed along the moving direction of the transfer/conveyance belt 60 as shown to FIG. 3. According to the present embodiment, the photo conductor drums 11K, 11Y, 11C, and 11M are installed in this sequence from the downstream side to the upstream side of the moving direction, the photo conductor drums 11K, 11Y, 11C, and 11M touching the transfer/conveyance belt 60.

The temperature sensor 21 measures the temperature of the outer surface (on which the printing medium 100 is supported) of the transfer/conveyance belt 60 at the outlet roller 62.

The temperature sensor 22 measures the temperature of the outer surface of the transfer/conveyance belt 60 at the drive roller 63.

The temperature sensor 23 measures the temperature of the inner surface (surface opposite to the outer surface) of the transfer/conveyance belt 60 between the outlet roller 62 and the drive roller 63.

The temperature sensor 24 measures the temperature of the inner surface of the transfer/conveyance belt 60 between the photo conductor drums 11Y and 11C.

Installing temperature sensors on the inner side of the transfer/conveyance belt 60, as practiced for the temperature sensors 23 and 24, has an advantage in that the dimensions of the image formation apparatus need not be enlarged, and that the temperature sensors do not interfere with other units and components.

The temperature sensors 21 through 24 may be contact-type temperature sensors that directly touch the transfer/conveyance belt 60, or may be non-contacting type temperature sensors that do not directly touch the transfer/conveyance belt 60.

If contact-type temperature sensors are used as the temperature sensors 21 through 24, accurate measurements of temperature change of the transfer/conveyance belt 60 are possible because the temperature sensors directly touch the transfer/conveyance belt 60, and the cost tends to be low.

On the other hand, if non-contact type temperature sensors are used as the temperature sensors 21 through 24, temperature measurements can be performed without adversely affecting the durability and service life of the transfer/conveyance belt 60.

Figure 4:
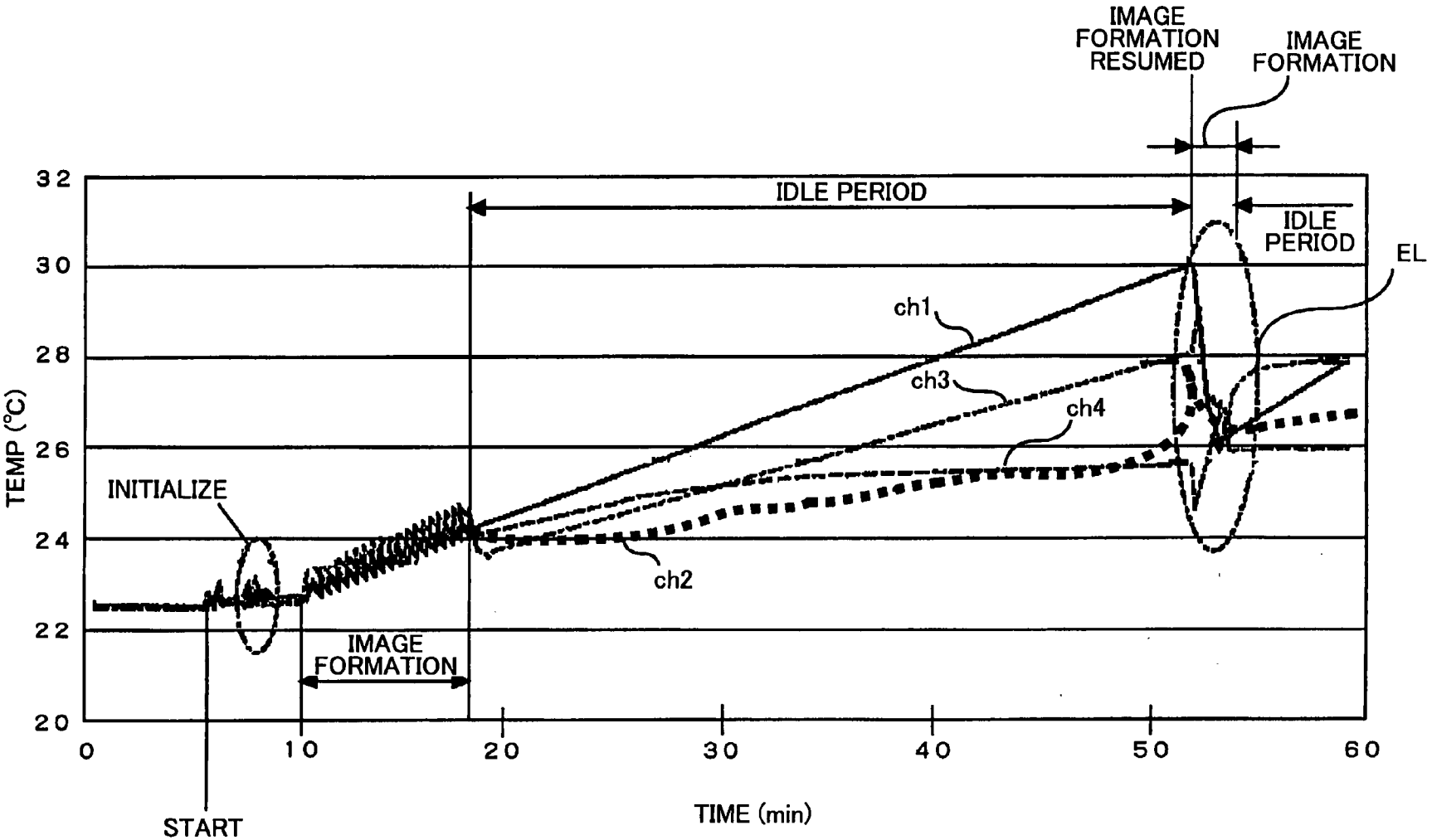
FIG. 4 graphs temperature changes of an intermediate imprinting belt measured by the temperature sensors according to the embodiment of the present invention.

FIG. 4 shows the temperature changes (temperature distribution) of the transfer/conveyance belt 60 as measured by the temperature sensors 21 through 24. In FIG. 4, the horizontal axis represents the time (minutes) and the vertical axis represents the temperature (degrees C.) of the transfer/conveyance belt 60.

Reference marks ch1, ch2, ch3, and ch4 in FIG. 4 represent the temperatures measured by the temperature sensors 21, 22, 23, and 24, respectively.

FIG. 4 shows the results in the case wherein the image formation apparatus was started, an initialization process was performed, a predetermined number of sheets (100 sheets, here) of a given size (A3 size, here) were processed by the transfer/conveyance belt 60, the transfer/conveyance belt 60 was stopped and left idle, and then a predetermined number (20, here) of sheets (A3 size, here) were processed. The idle period (i.e., between the $100^{th}$ sheet and the $101^{st}$ sheet) in this case was set at 30 minutes.

FIG. 4 shows that the temperatures of different parts of the transfer/conveyance belt 60 widely varied after the idle period. The temperature variance among the measuring places when the $101^{st}$ sheet was processed was remarkably different from the temperature variance when the $1^{st}$ sheet was processed. That is, since the transfer/conveyance belt 60 was continuously moving when processing the first 100 sheets that were processed first after the starting of the image formation apparatus, the temperature distribution in the moving direction of the transfer belt 60 was almost uniform, and temperatures rose almost uniformly at each of the measuring places.

However, when image formation was suspended, and the image formation apparatus was made idle with the transfer/conveyance belt 60 stopping, the fixing unit heated the nearby roller (typically, the outlet roller 62), the nearby roller heated the transfer/conveyance belt 60, and the mechanical intensity of the heated part of the transfer/conveyance belt 60 changed. This stretched the heated part of the transfer/conveyance belt 60 in the moving direction. Due to the stretching, the upstream side of the heated part was conveyed at a speed lower than a predetermined target conveyance speed.

The stretching caused a change in the starting position of image formation on the transfer/conveyance belt 60, and accordingly caused the color gap to occur.

Figure 5:
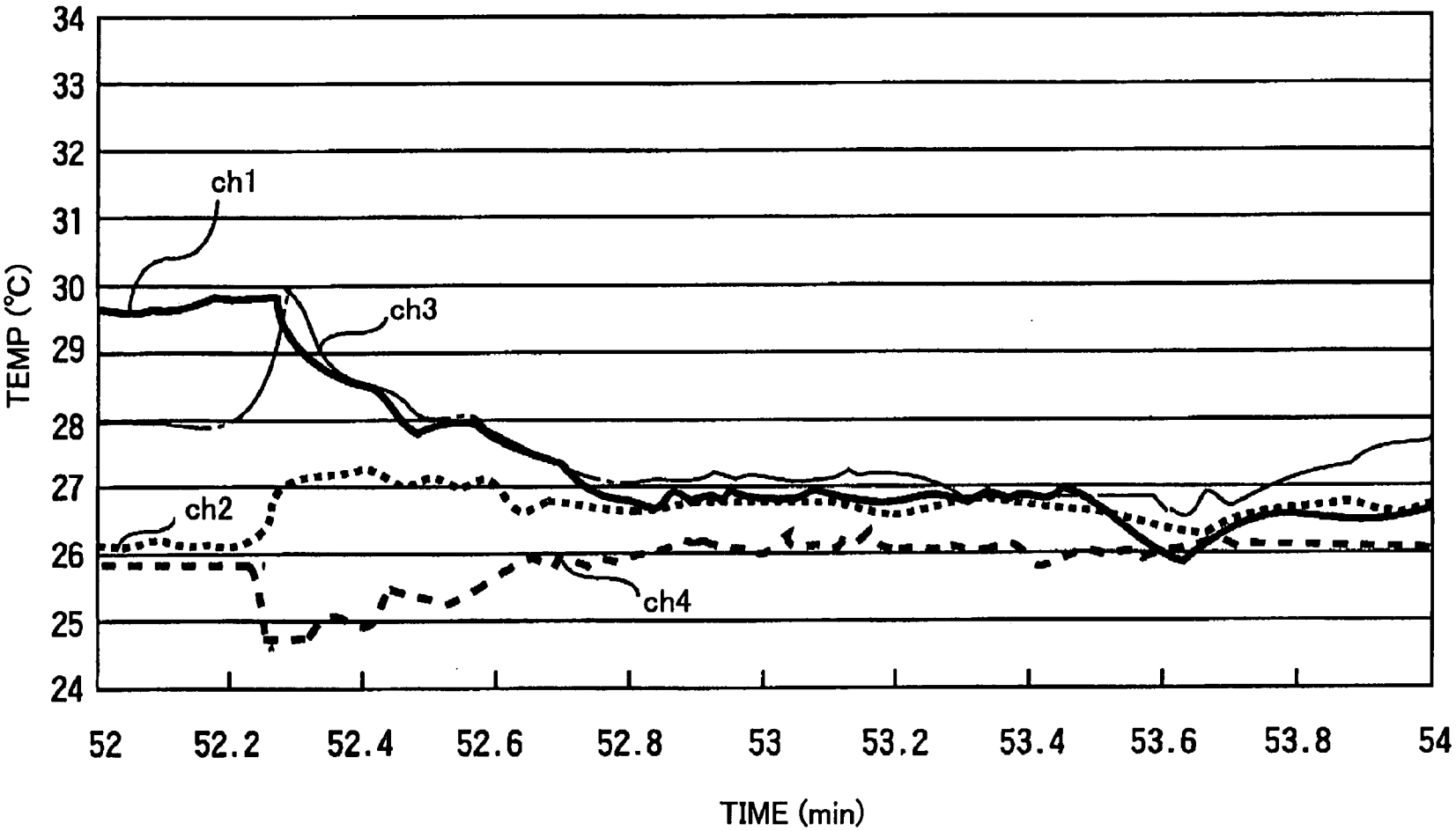
FIG. 5 graphs the temperature changes of the intermediate imprinting belt measured by the temperature sensors according to the embodiment of the present invention in the case that an image is formed after an idle period.

FIG. 5 shows the temperature changes (temperature distribution) of the transfer/conveyance belt 60 as measured by the temperature sensors 21 through 24 when an image was formed for the first time after the idle period. That is, FIG. 5 shows the temperature changes shown within the ellipse EL of FIG. 4 in more detail. In FIG. 5, the horizontal axis represents the time (minute), and the vertical axis represents the temperature (degrees C.) of the transfer/conveyance belt 60.

In FIG. 5, the temperatures indicated by reference marks ch1, ch2, ch3, and ch4 represent the temperatures measured by the temperature sensors 21, 22, 23, and 24, respectively.

Here, descriptions follow about the changes of the temperature (ch1) at a measuring point near the outlet roller 62, and the changes of the temperature (ch3) at a-measuring point between the outlet roller 62 and the drive roller 63.

The temperature (ch1) at about the outlet roller 62 gradually fell as the transfer/conveyance belt 60 started moving, and became almost equal to the temperatures of other measuring points (ch2 through ch4) in about 40 seconds. The number of sheets wherein color gaps were generated corresponded to the time period while the temperature was falling.

The temperature (ch3) of the measuring point between the outlet roller 62 and the drive roller 63 became equal to the temperature (ch1) as soon as the printing medium started moving. From this, it was determined that the heat was transferred to the transfer/conveyance belt 60 from the outlet roller 62.

As described above, color gaps were generated on the first several sheets processed after the idle period; as the number of sheets that were processed increased, the temperature distribution over the transfer belt 60 was equalized; after about 10 sheets were processed, color gaps were no longer generated.

Figure 6:
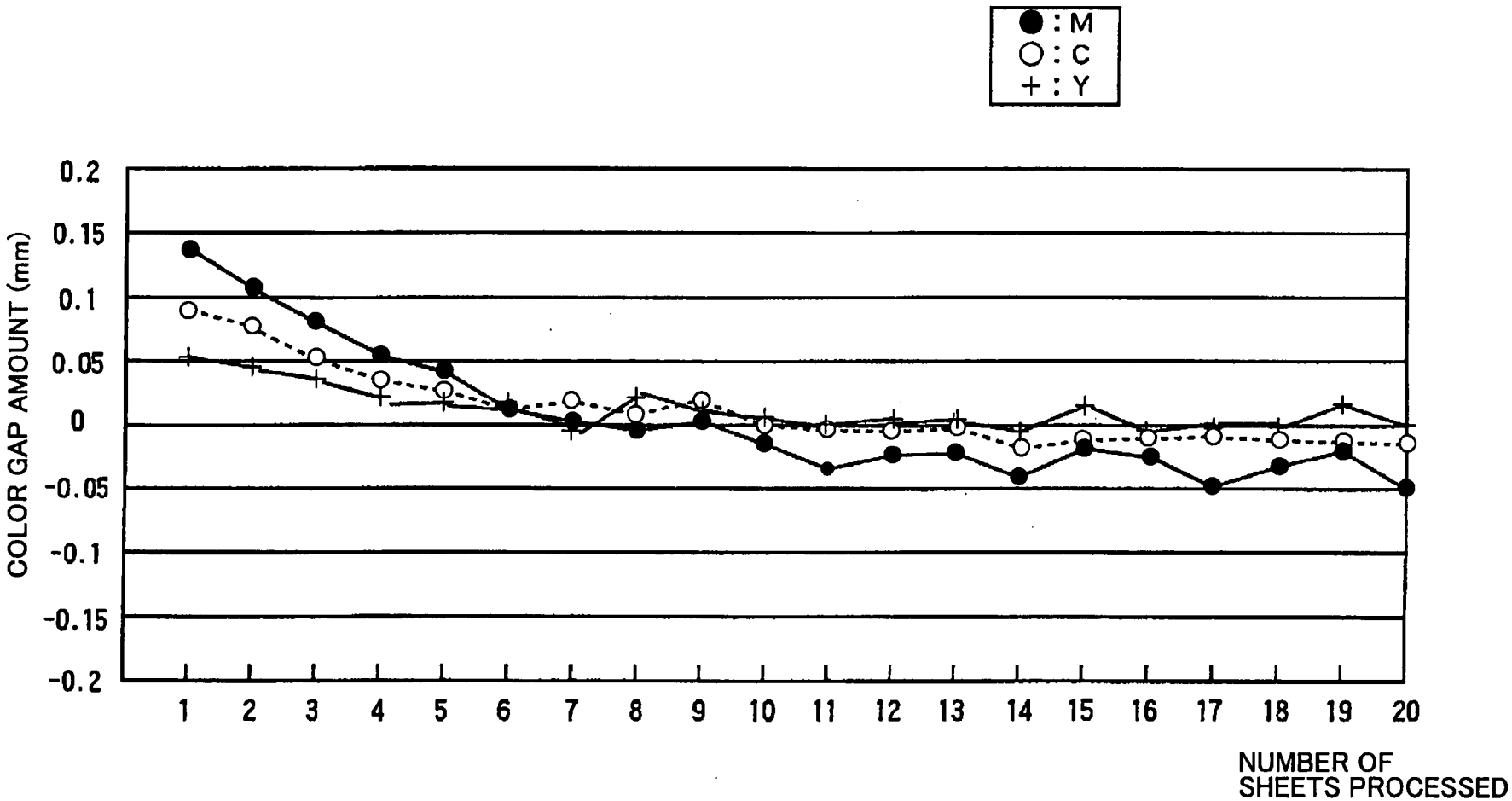
FIG. 6 graphs a superposed position gap of one of colors (C, M, and Y) to a reference color (K) according to the embodiment of the present invention.

FIG. 6 shows amounts of the color gaps of C, M, and Y colors in reference to color (K) according to the first embodiment of the present invention. The vertical axis of FIG. 6 represents the amount of color gaps (mm) of each color C, M, and Y in reference to K, and the horizontal axis represents the number of sheets processed (equivalent to elapsed time) after the idle period, namely, from the first sheet up to the 20th sheet.

In FIG. 6, dots represent M (magenta), circles represent C (cyan), and "+" marks represent Y (yellow).

Color gaps between each color and the black settled down with the lapse of time in the process after the idle period as shown in FIG. 6.

Figure 7:
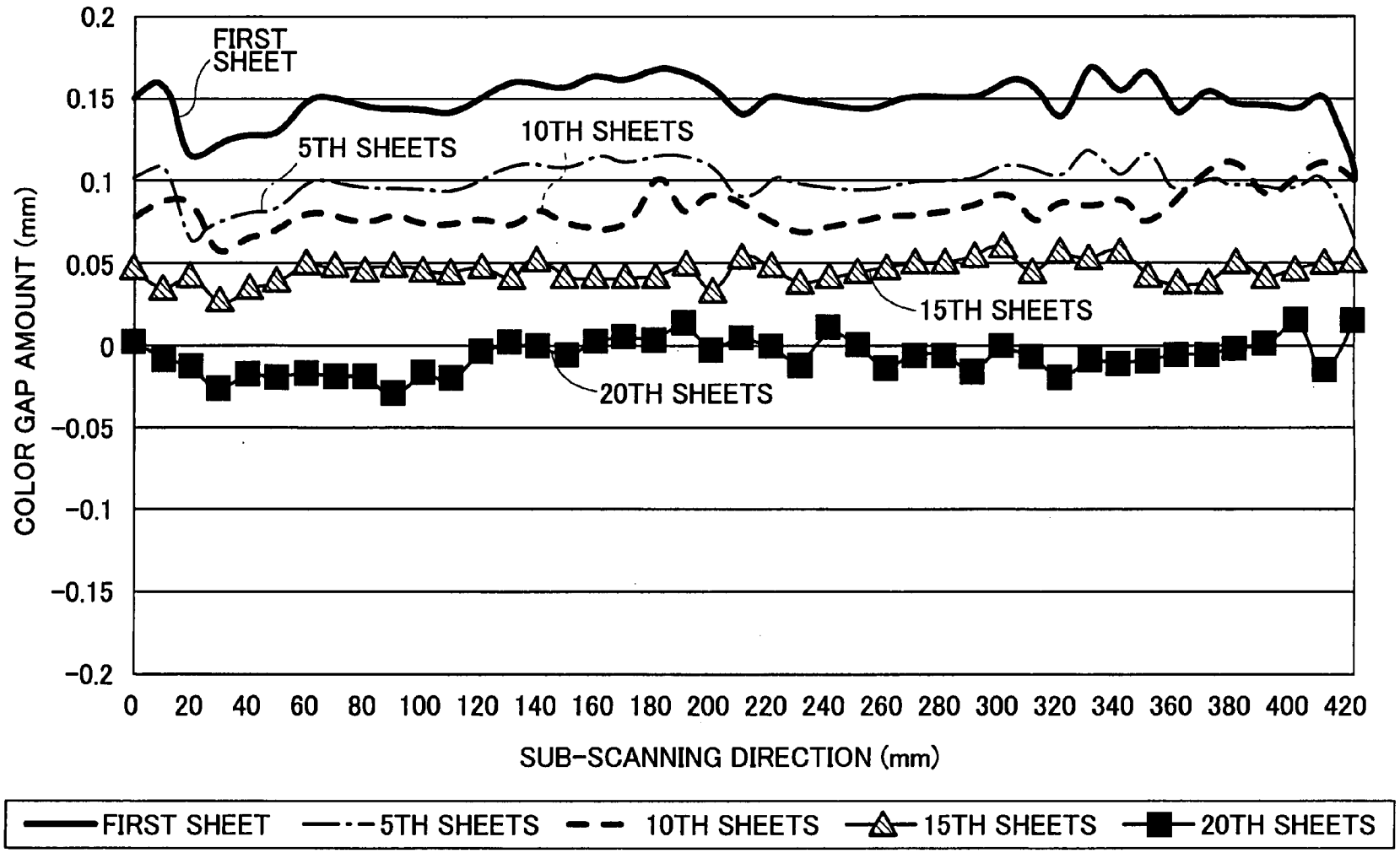
FIG. 7 graphs position relations between the magenta color M and the black color K with the vertical axis representing an amount (size) of a color gap M-K, and the horizontal axis representing a position of a printing medium in sub-scanning directions according to the embodiment of the present invention.

FIG. 7 is a graph that shows position relations between M (magenta) and K (black) with the vertical axis representing the amount of color gaps M-K as an example, and the horizontal axis representing positions on the printing medium 100 (A3 in size in this example) in the sub-scanning direction (i.e., lines on the printing medium) according to the first embodiment of the present invention.

As mentioned above, the vertical axis represents the difference between positions of M and K. Accordingly, if the difference takes a positive value, it signifies that K was printed later than a predetermined point in time. In other words, the conveyance speed after M was printed until K was printed was slower than the predetermined target speed. To the contrary, if the difference takes a negative value, it signifies that the speed after M was printed until K was printed was faster than the predetermined target speed.

FIG. 7 shows that the first sheet processed after the idle period had the greatest color gaps, and as the number of sheets processed increased, color gaps were gradually lessened.

Figure 8:
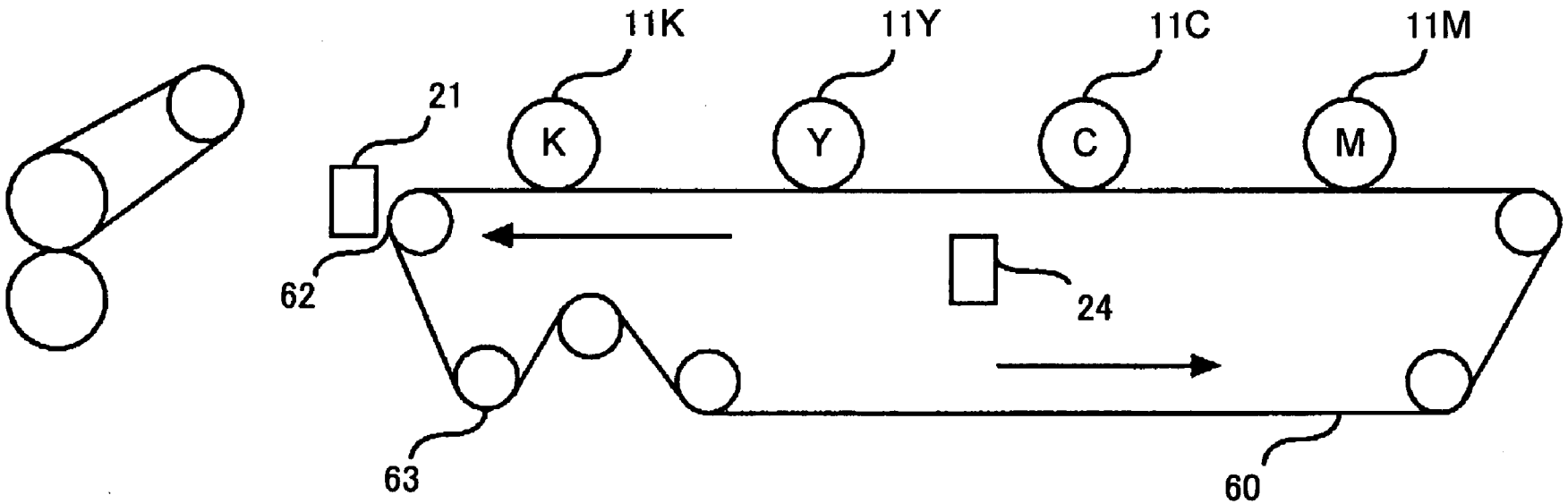
FIG. 8 shows another configuration of the printing unit that performs the temperature measurement according to the embodiment of the present invention.

FIG. 8 shows another configuration of the transfer unit 6, including the transfer/conveyance belt 60, for performing the temperature measurement according to the first embodiment of the present invention.

With the configuration of FIG. 8, temperature sensors are provided at places where the temperature of the transfer/conveyance belt 60 gets the highest during the idle period (i.e., near the outlet roller 62, that is, the measuring point of the temperature sensor 21), and at the center of the transfer (imprint) area (i.e., the measuring point of the temperature sensor 24).

By providing at least two temperature sensors at places that have a variance in the temperature distribution in the moving direction of the transfer/conveyance belt 60, a simple and economical temperature measurement is realized.

Figure 9:
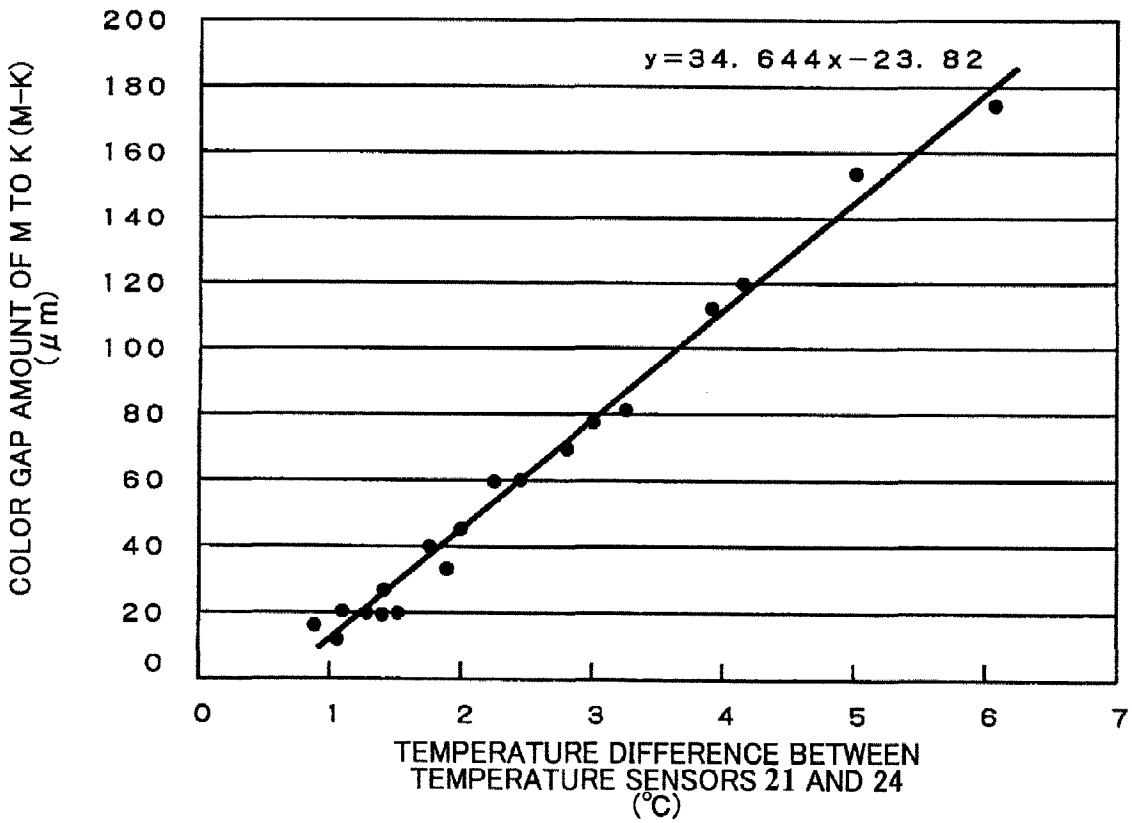
FIG. 9 graphs relations between temperature differences measured by two temperature sensors after an idle period, and the amount of a color gap appearing on the sheet processed after the idle period.

FIG. 9 is a graph that shows relations between the difference of the temperatures measured by the temperature sensors 21 and 24 after the idle period (i.e., after resumption of image formation), and the amount of color gaps of M with reference to K.

The relations concerning the configuration as shown by FIG. 8 are reduced to a linear equation as follows.

$y=ax+b$, where y represents the amount of color gaps (μm), x represents the temperature difference between the temperature sensors 21 and 24 (degree C.), and a and b are constants.

In the case of the relations shown in FIG. 9, the linear equation is expressed as:

$$y=34.644x-23.82$$

Here, the relations being linear is maintained regardless of the environment (low-temperature and low humidity, normal temperature and normal humidity, high temperature and high humidity), which was ascertained by experiments.

Next, descriptions follow as to how the color gaps generated by the temperature variances over the transfer/conveyance belt 60 are compensated for.

Since the amount of the color gaps M-K that are expected to be generated due to the difference in temperatures measured by the temperature sensors 21 and 24 is computable based on the relations as described above, color gaps between colors can be easily compensated for. Specifically, the timing of writing by the exposure unit to the photo conductor drum 11M (equivalent to writing position) is beforehand adjusted (the phase of a pixel clock that drives the exposure unit is advanced or delayed) as appropriate for compensating for the color gap that may be generated otherwise. Further, the relations as shown by FIG. 9 can be drawn for sections between C and K, and between Y and K by performing the same process.

Figure 10:
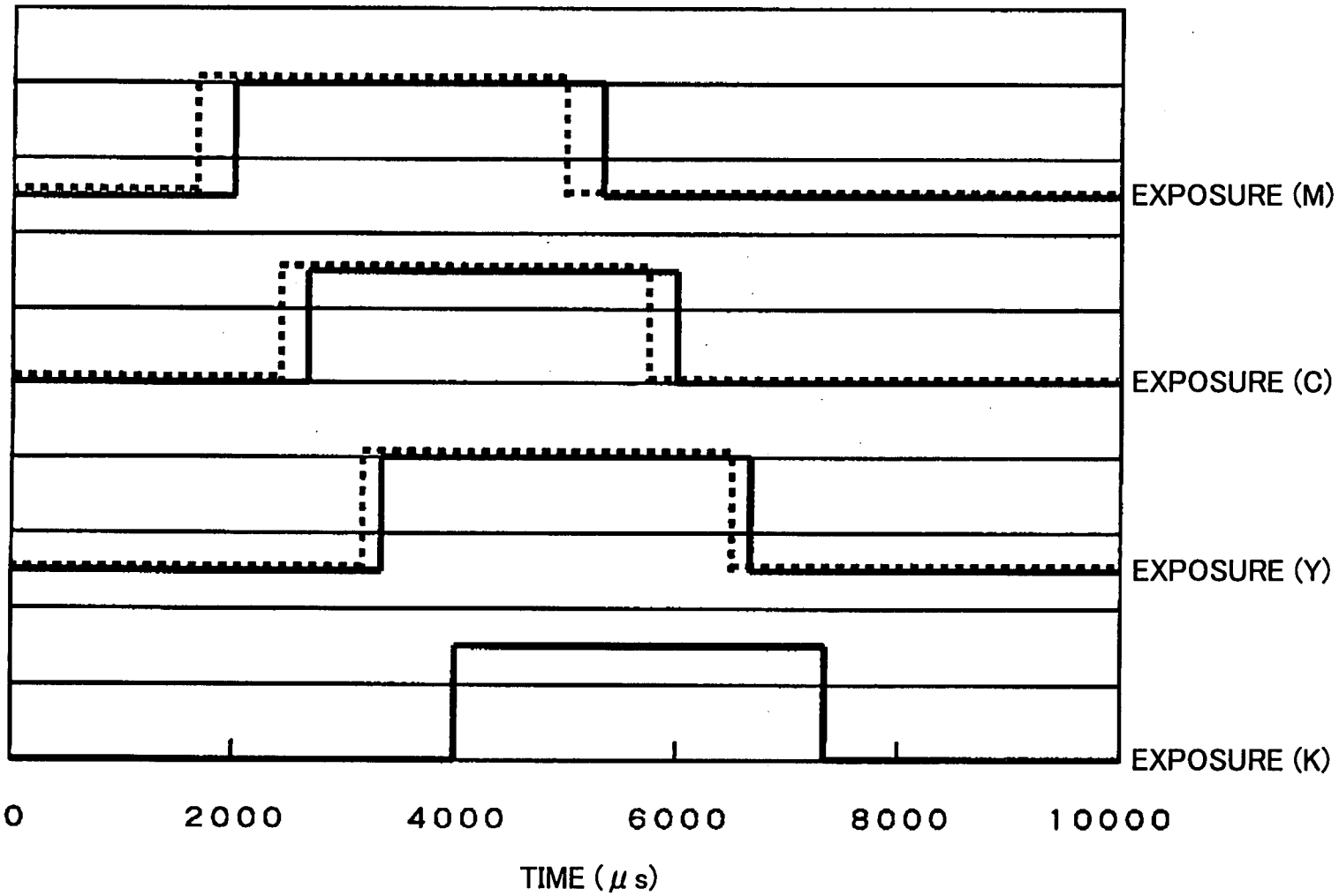
FIG. 10 is a timing chart that shows how writing timing of an image in each of C, M, and Y colors is adjusted according to the embodiment of the present invention.

FIG. 10 shows an example of a timing chart that defines the writing timing of the images in C, M, Y, and K colors by the exposure unit according to the first embodiment of the present invention.

Solid lines show the pixel clock before compensation for C, M, and Y colors, and dotted lines show the pixel clock after compensation.

According to the present embodiment, the image formation apparatus includes an exposure control unit (not illustrated) for controlling the writing timing of the exposure unit that forms an image on each of the photo conductor drums 11M, 11C, 11Y, and 11K.

The exposure control unit controls the exposure unit by providing the pixel clock that shifts the writing timing, corresponding to the amount of color gaps that may occur otherwise, based on the above linear equation and the temperatures measured by the temperature sensors 21 and 24. In this manner, the color gaps of C, M, and Y colors with reference to K are substantially eliminated.

Further, the temperature difference generated in the conveyance belt 60 is gradually diminished as conveyance finishes. Accordingly, the exposure control unit controls the exposure timing for forming the image on the photo conductor drums 11Y, 11M, 11C, and 11K based on the difference between temperatures measured by the temperature sensors 21 and 24 such that the color gaps are compensated for until the temperature difference is diminished.

In the case that an image formation apparatus is capable of operating at two or more image transfer speeds and/or print medium conveyance speeds, the relations that are shown in FIG. 9 between the amount (μm) of color gaps and the difference of temperatures (degrees C.) measured by the temperature sensor 21 and the temperature sensor 24 differ by such speeds. According to the embodiment, the exposure timing is controlled based on such speeds such that color gaps are compensated for until the temperature difference is diminished.

Further, the relations also change with the kinds of the printing medium conveyed. Accordingly, the exposure control unit of the present invention controls the exposure timing based on the kinds of the printing medium such that color gaps are compensated for until the temperature difference is diminished.

Furthermore, the relations also change with paper sizes. Accordingly, the exposure control unit of the present invention controls the exposure timing based on the kinds of the printing medium such that color gaps are compensated for until the temperature difference is diminished.

In addition, control of the write-in timing to the printing medium for compensating for color gaps can also be carried out by changing the timing of image transfer of certain colors in reference to a reference color.

As described above, according to the present embodiment, since the temperature difference between two or more places of the transfer/conveyance belt 60 in the moving direction, and the amount of color gaps between the colors are proportionally related, the color gaps between the colors can be easily eliminated by measuring the temperatures of the transfer/conveyance belt 60, and by reflecting the temperature differences in the writing timing.

Figure 12:
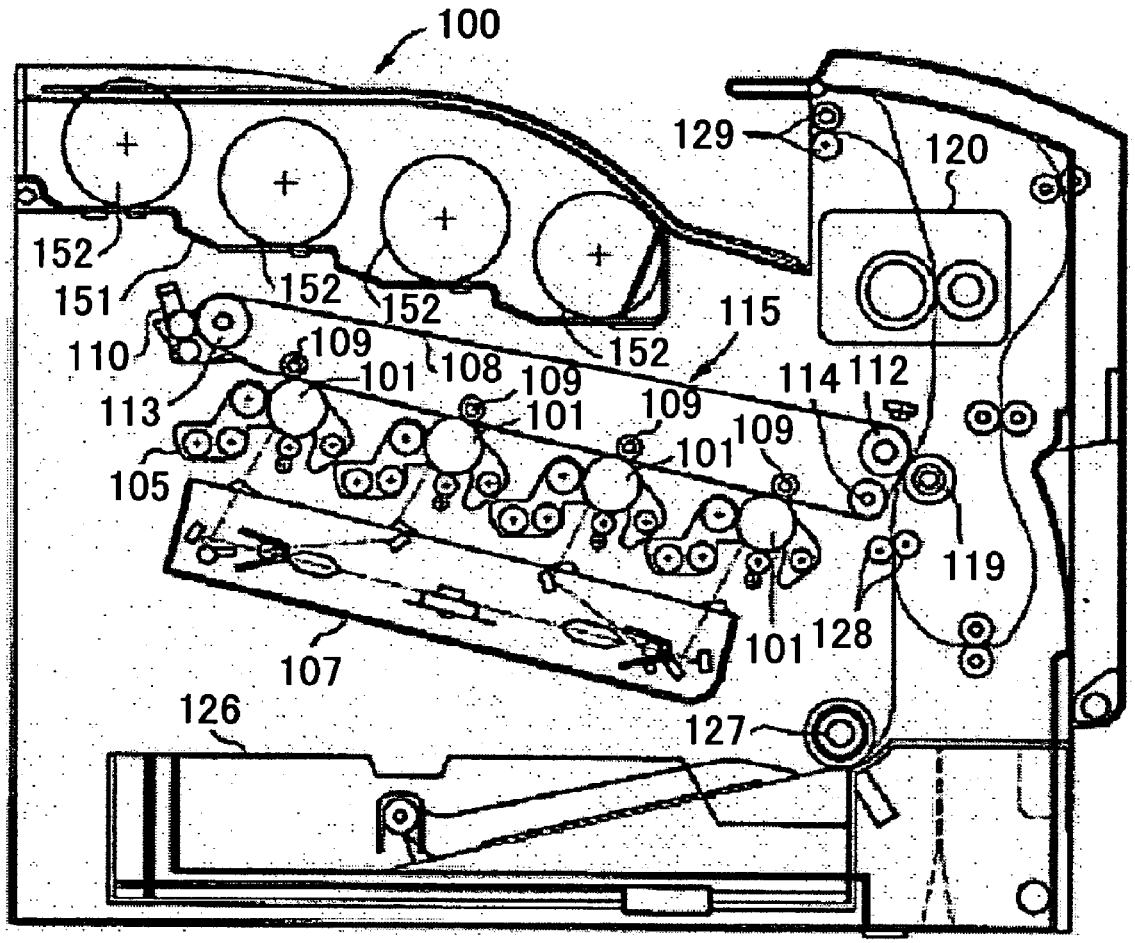
FIG. 12 shows the outline configuration of an image formation apparatus using an intermediate transfer method according to the embodiment of the present invention.

Although the present embodiment is so far described using the direct imprint method, it is also possible to use the transfer/conveyance belt 60 as an intermediate imprinting belt, and to apply the configuration of the embodiment to an image formation apparatus of an intermediate imprint method as shown by FIG. 12.

The Second Embodiment

Hereafter, the second embodiment of the present invention is described. The second embodiment is the same as the first embodiment except as described in the following.

The image formation apparatus using the intermediate imprint method according to the present invention is shown in FIG. 12, which includes a photo conductor drum 101, a development unit 105, a laser scanning unit (LSU) 107, a transfer roller 109, a cleaning unit 110, a follower roller 112, a drive roller 113, an entrance roller 114, an intermediate imprinting belt 115, a secondary transfer roller 119, a fixing unit 120, a printing medium tray 126, a feed roller 127, a resist roller 128, a delivery roller 129, a separator 151, a-toner bottle 152, and a delivery tray 200. Configuration otherwise is the same as that of the image formation apparatus using the direct imprint method as shown in FIG. 1.

Figure 11:
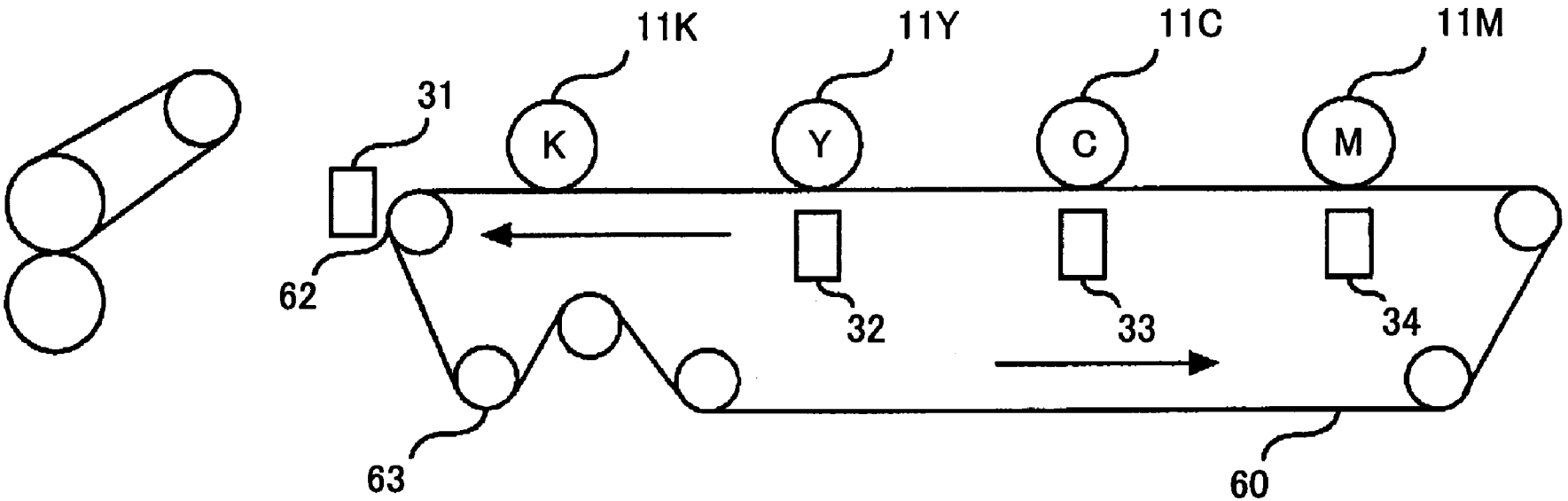
FIG. 11 shows the configuration of the printing unit for performing the temperature measurement according to the embodiment of the present invention.

FIG. 11 shows the configuration of the transfer unit 6, including the transfer/conveyance belt 60, according to the second embodiment of the present invention.

Specifically, two or more temperature sensors for measuring temperatures of the transfer/conveyance belt 60 are installed along the moving direction of the transfer/conveyance belt 60 as shown in FIG. 11. In an example described below, four temperature sensors 31 through 34 are provided.

The temperature sensor 31 measures the temperature of the outer-side surface of the transfer/conveyance belt 60 at a position near the outlet roller 62, where the temperature becomes the highest on the transfer/conveyance belt 60.

The temperature sensors 32, 33, and 34 measure the temperatures of the inner-side surface of the transfer/conveyance belt 60 at positions that are opposite to the photo conductor drums 11Y, 11C, and 11M, respectively.

The temperatures of the transfer/conveyance belt 60 immediately after the idle period vary widely from position to position (the closer to the outlet roller 62, the higher the temperature is). Then, the temperature sensors 32, 33, and 34 are arranged for measuring temperatures at the imprint positions of corresponding colors, such that the measured temperatures are used for controlling the writing timing, and the color gaps are prevented from occurring, especially on first sheets processed after the idle period.

The process for calculating the amount of color gaps between the colors according to the first and the second embodiments of the present invention is performed by a computer program loaded into the image formation apparatus. The computer program may be stored in a recording medium, such as an optical recording medium, a magnetic recording medium, a magneto-optical recording medium, and a semiconductor memory, and loaded into the image formation apparatus from such recording medium. Further, the computer program may be loaded from an external source via a network.

Further, the present invention is not limited to these embodiments, but various variations and modifications may be made without departing from the scope of the present invention.

The present application is based on Japanese Priority Applications No. JPA 2004-126004 filed on Apr. 21, 2004, and No. JPA 2003-195410 filed on Jul. 10, 2003, with the Japanese Patent Office, the entire contents of those are hereby incorporated by reference.

What is claimed is:

1. An image formation apparatus, comprising:

an exposure unit configured to expose an image supporting object that is uniformly charged, and to form an image in a plurality of colors;

a printing medium conveyance unit configured to convey a printing medium, an intermediate transfer unit configured to temporarily receive the image and transfer the image to said printing medium that is conveyed by said printing medium conveyance unit;

a temperature measurement unit configured to measure temperatures of a plurality of places of said intermediate transfer unit; and an exposure control unit configured to control timing of exposure performed by said exposure unit by calculating expected color gaps between the colors of the image formed at image forming positions of said image supporting object based on differences in temperatures between the places of said intermediate transfer unit, said difference in temperature being obtained by directly calculating a difference between the temperatures measured at said places of the intermediate transfer unit and by adjusting the timing of exposure such that said expected color gaps are prevented from occurring.

2. The image formation apparatus as claimed in claim 1, wherein said temperature measurement unit is configured to measure the temperatures of at least two places of said intermediate transfer unit where the temperatures are different.

3. The image formation apparatus as claimed in claim 1, wherein said temperature measurement unit is configured to measure the temperatures of one of the places of said intermediate transfer unit, the temperature of which place is no lower than any other of the places of said intermediate transfer unit, and one or more imprint positions of said colors.

4. The image formation apparatus as claimed in claim 1, wherein said temperature measurement unit contacts said intermediate transfer unit.

5. The image formation apparatus as claimed in claim 1, wherein said temperature measurement unit does not contact said intermediate transfer unit.

6. The image formation apparatus as claimed in claim 1, wherein said intermediate transfer unit comprises an endless belt supported by a plurality of rollers with tension applied.

7. The image formation apparatus as claimed in claim 6, wherein said temperature measurement unit is installed within an area that is delimited by said intermediate transfer unit.

8. The image formation apparatus as claimed in claim 1, wherein said exposure control unit is configured to control said exposure timing for every speed of an image being imprinted by said exposure unit to said printing medium.

9. The image formation apparatus as claimed in claim 1, wherein said exposure control unit is configured to control said exposure timing for every speed of said printing medium being conveyed.

10. The image formation apparatus as claimed in claim 1, wherein said exposure control unit is configured to control said exposure timing for every kind of said printing medium.

11. The image formation apparatus as claimed in claim 1, wherein said exposure control unit is configured to control said exposure timing for every size of said printing medium.

12. The image formation apparatus as claimed in claim 1, wherein said exposure control unit is configured to control said exposure timing of each of said colors other than a reference color that is predetermined from said colors in reference to the exposure timing of said reference color such that said expected color gaps are compensated for.

13. An image formation apparatus, comprising:

an exposure unit configured to expose and form an image in a plurality of colors on a plurality of image supporting objects that are electrically charged uniformly, each image supporting object being assigned to one of the colors;

a transfer unit configured to imprint said one-color images formed on said image supporting objects onto a printing medium;

a printing medium conveyance unit configured to convey said printing medium to imprint positions of said transfer unit;

a temperature measurement unit configured to measure temperatures of a plurality of places on said printing medium conveyance unit; and an exposure control unit configured to control timing of exposure carried out by said exposure unit based on differences in said temperatures measured at said plurality of places on said printing medium conveyance unit.

14. The image formation apparatus as claimed in claim 13, wherein said exposure control unit is configured to compute expected variances of formation positions of said one-color images in two or more of the colors if formed on said printing medium based on differences of the temperatures between two or more of the places on said printing medium conveyance unit, said temperatures being measured by said temperature measurement unit, and configured to control the timing of exposure carried out by said exposure unit such that said expected variances of the image formation positions between the two or more colors are substantially eliminated.

15. The image formation apparatus as claimed in claim 13, wherein said temperature measurement unit measures the temperatures of at least two of the places of said printing medium conveyance unit, the temperatures of which places are different from each other.

16. The image formation apparatus as claimed in claim 13, wherein said temperature measurement unit measures the temperature of said printing medium conveyance unit at one of the places, the temperature of which place is no lower than any other of the places, and at one or more of the imprint positions.

17. The image formation apparatus as claimed in claim 13, wherein said temperature measurement unit contact said printing medium conveyance unit.

18. The image formation apparatus as claimed in claim 13, wherein said temperature measurement unit does not contact said printing medium conveyance unit.

19. The image formation apparatus as claimed in claim 13, wherein said printing medium conveyance unit comprises an endless belt supported by a plurality of rollers with tension.

20. The image formation apparatus as claimed in claim 19, wherein said temperature measurement unit is installed within an area that is delimited by said printing medium conveyance unit.

21. The image formation apparatus as claimed in claim 13, wherein said exposure control unit is configured to control said exposure timing for every speed of an image being imprinted by said exposure unit on said printing medium.

22. The image formation apparatus as claimed in claim 13, wherein said exposure control unit is configured to control said exposure timing for every speed of said printing medium being conveyed.

23. The image formation apparatus as claimed in claim 13, wherein said exposure control unit is configured to control said exposure timing for every kind of said printing medium.

24. The image formation apparatus as claimed in claim 13, wherein said exposure control unit is configured to control said exposure timing for every size of said printing medium.

25. The image formation apparatus as claimed in claim 13, wherein said exposure control unit is configured to control said exposure timing of each of said colors other than a reference color that is predetermined from said colors in reference to the exposure timing of said reference color such that said expected color gaps are compensated for.

26. The image formation apparatus as claimed in claim 1, wherein the temperature measurement unit includes a temperature sensor for measuring the temperature of a back face of the intermediate transfer unit between a roller located closest to a fixing unit and a drive roller.

* * * * *